US008387751B2

(12) United States Patent
Miceli

(10) Patent No.: US 8,387,751 B2
(45) Date of Patent: Mar. 5, 2013

(54) FOLLOW-UP FALL PREVENTION DEVICE

(76) Inventor: Olivier Miceli, Marseilles (FR)

( * ) Notice: Subject to any disclaimer, the term of this patent is extended or adjusted under 35 U.S.C. 154(b) by 234 days.

(21) Appl. No.: 12/679,095

(22) PCT Filed: Sep. 26, 2007

(86) PCT No.: PCT/FR2007/001573

§ 371 (c)(1),
(2), (4) Date: Mar. 19, 2010

(87) PCT Pub. No.: WO2009/040481

PCT Pub. Date: Apr. 2, 2009

(65) Prior Publication Data

US 2010/0300809 A1 Dec. 2, 2010

(51) Int. Cl.
*A62B 1/14* (2006.01)

(52) U.S. Cl. ..... 182/5; 182/192

(58) Field of Classification Search ..... 182/5, 191, 182/192; 188/65.4, 65.5
See application file for complete search history.

(56) References Cited

U.S. PATENT DOCUMENTS 3,335,469 A 8/1967 George et al.
3,948,362 A * 4/1976 Greest ..... 188/65.2
6,155,384 A * 12/2000 Paglioli ..... 188/65.2
7,108,099 B2 * 9/2006 Ador ..... 182/5
8,096,385 B2 * 1/2012 Tarkhani et al. ..... 182/192
2006/0207829 A1 * 9/2006 Mauthner ..... 182/5

FOREIGN PATENT DOCUMENTS

DE 10 2004 019714 A1 11/2005
FR 2 880 283 A1 7/2006
FR 2 898 813 A 9/2007

OTHER PUBLICATIONS

International Search Report, Jun. 10, 2008, from International Phase of the instant application.
English Translation of International Preliminary Report on Patentability Chapter I, May 4, 2010, from International Phase of the instant application.

* cited by examiner

*Primary Examiner* — Janet M Wilkens
*Assistant Examiner* — Kristine Florio
(74) *Attorney, Agent, or Firm* — Jackson Patent Law Office

(57) ABSTRACT

Disclosed is a follow-up fall prevention device used with a cord designed to secure a person. The device includes a blocking system having a pressure mechanism configured, during running of the cord, to be between the free weight and the bearing surface and to bias a free weight toward the cord and away from a bearing surface, thereby enabling the free weight to be always in contact with the cord and remain in the lower part of a cavity without touching the bearing surface, whatever the inclination of the cord and whatever the position of the device. The pressure mechanism includes a spring.

7 Claims, 3 Drawing Sheets

FIG. 1
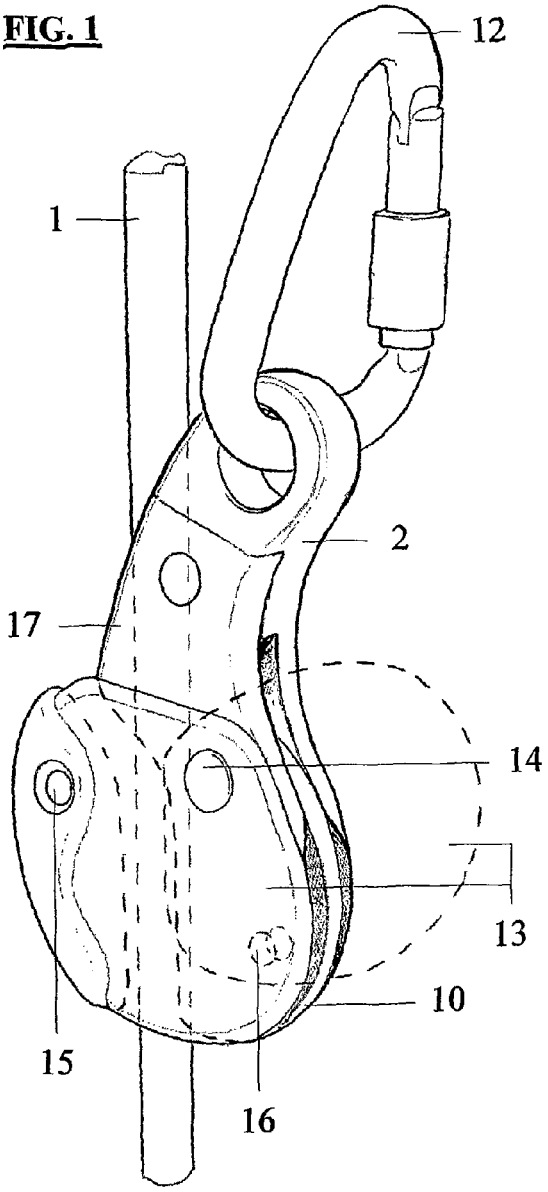
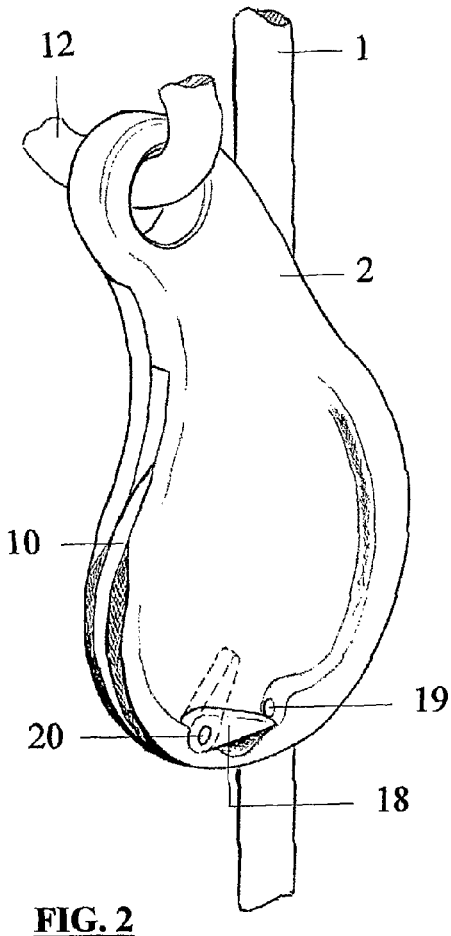
FIG. 2

FIG. 3
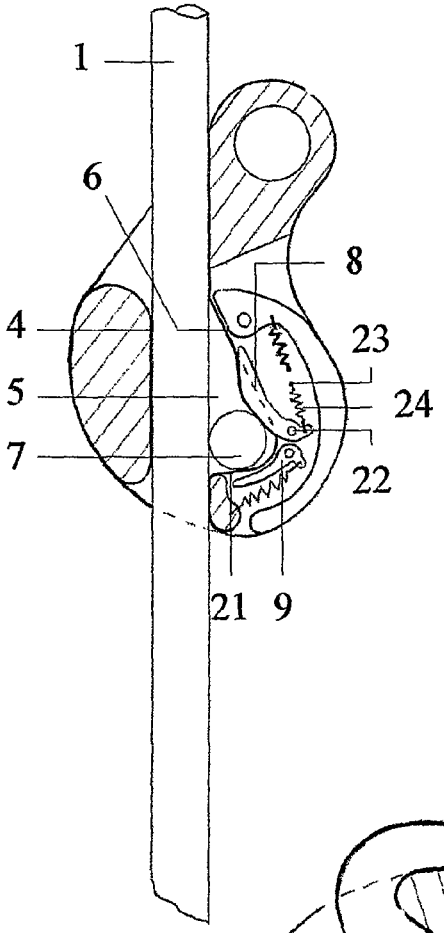
FIG. 4
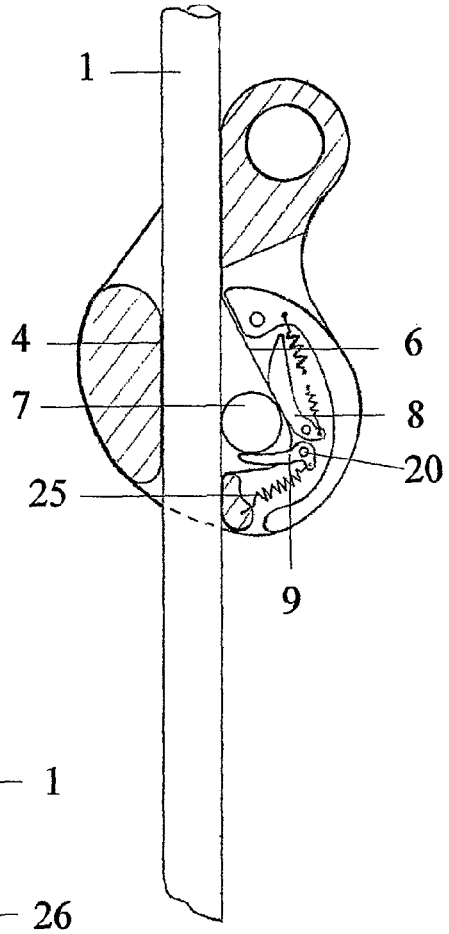
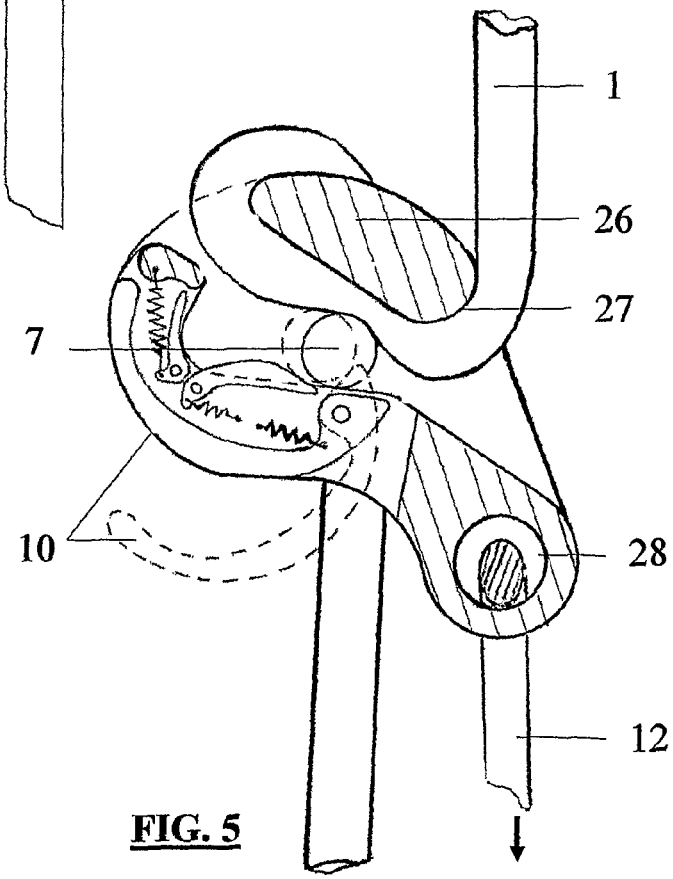
FIG. 5

FOLLOW-UP FALL PREVENTION DEVICE

The present invention relates to a follow-up fall prevention device used with a safety cord for securing the tower worker, climber, and others, comprising:

- a body equipped with a blocking system having an active position of blocking the cord during the rapid running of said cord in the device caused for example by a fall, or an inactive position allowing the controlled running of the cord in the device corresponding to the progression of a person in the ascent direction, or in the opposite direction during a controlled descent
- straps means for the connection of the body of the device to a security harness.

Such a device is for example known from the patents FR2842113, U.S. Pat. No. 4,923,037 and DE 102004019714A1.

The known blocking systems of fall prevention devices have multiple disadvantages:

- they have a faulty reliability during a controlled descent when the cord is inclined. Their blocking systems is generally a cam that can present a risk if there is a mishandling of the device
- they generally have no means enabling only back-climbing along the cord.
- they generally have no means enabling descent suspended from the cord after a fall
- they deteriorate the cords very rapidly
- they are generally heavy and bulky
- they do not generally enable securing of another person The object of this invention has a goal of eliminating these drawbacks.

The device according to this invention is provided with a blocking system comprising:

- on one side of the cord at least a cord bearing surface
- on the other side of the cord at least a cavity containing in the lower part at least a free weight and forming in the upper part at least a bearing surface inclined toward the cord, the free weight being adapted during a rapid running of the cord to be displaced toward the inclined bearing surface until the blocking of the cord between said free weight and the cord bearing surface. The device being characterized in that the blocking system is provided with a pressure member enabling, during a controlled running of the cord, the free weight to be always in contact with the cord and remain in the said lower part of the cavity without touching the inclined bearing surface, whatever the inclination of the cord and whatever the position of the device. Another characteristic is that the pressure member pushes on an axel enabling the spinning of the free weight and that this said axel is rotationally free relative to the free weight, the latter being a rim. In another implementation mode the free weight can comprise an off-center mass, the blocking system can comprise a wheel carriage located between said free weight and the inclined bearing surface, said weight comprising at least a surface adapted to receive the said wheel carriage. Said free weight has a smooth surface condition in order to not deteriorate the cord. Also the coefficient of friction of the cord on the free the weight is greater than the coefficient of friction of other contact areas on said free weight. Another characteristic is that the blocking system is equipped with a lever enabling release of said free weight when the free weight is in blocked position against the cord and even when the latter is under load which allows the braked running of the said cord during the descent of the user for example.

The device is further characterized in that the blocking system is provided with a manually activated pushing member enabling the free weight to be in contact with the cord and with the inclined bearing surface, which enables only the running of the cord in one direction and the blocking in the other direction.

The result of this invention is a safety device, follow-up fall prevention, blocker and descender. This new device thus offers possibilities of back-climbing on a fixed cord, of controlled descent and ascent along the fixed cord, of a descender function when the user is suspended by the device after a fall or during a descent by rappelling and it is also used in order to secure another person. The device is then attached to a person on the ground that carries out the belaying by guiding the running in the device of the mobile cord connected to the other person, thus enabling the progression of the climber or worker in safety.

The description that will follow is made by way of indicative and non limiting example viewed with the accompanying drawings wherein:

FIG. 1 is a perspective view of the device installed on a safety cord (1)

FIG. 2 is a perspective view showing the other side of the device

FIG. 3 is a sectional view showing the device in "fall prevention follow-up" mode FIG. 4 is a sectional view showing the device in "blocker" mode FIG. 5 is a sectional view showing the device in "descender" mode

Figure 6:
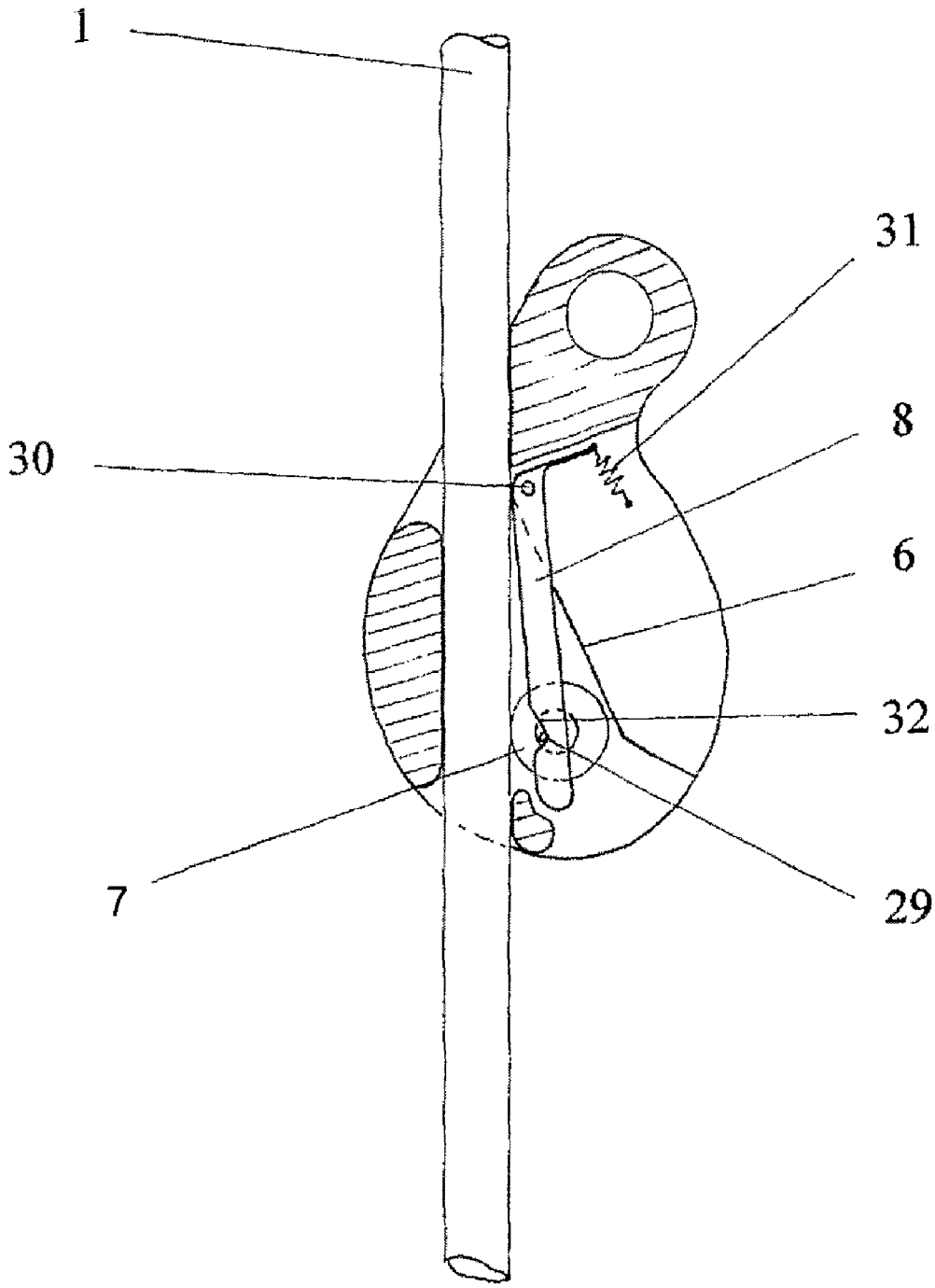
FIG. 6 is a sectional view showing another implementation mode of the pressure member (8).

FIGS. 1 and 2 show an implementation example. It is shown, in perspective, in use position installed on a safety cord (1). An attachment carabiner (12) generally connects the device to the harness of the user, the latter not being represented.

The device according to this invention can be used to secure another person with a mobile safety cord. The device will be attached to the person on the ground and installed on a mobile cord (1) connecting the climber. Thus during a belay by "topcord", the mobile safety cord generally slides in a ring attached at the top of the wall, or where a climber ascends "in the lead". Then he connects the mobile safety cord to rings attached in the wall via carabiners, as his progression goes along.

The device can also be used as a fall prevention follow-up. The device is then attached to the user and installed on a fixed safety cord attached to the top of the wall. The device thus self secures the user displacing himself along this fixed safety cord.

To simplify the description, the operation of the device will be explained in FIGS. 3, 4, 5 when the device is used as fall prevention installed on a fixed cord (1), for the operation of the device is similar when it is used to secure another person.

When used as follow-up fall prevention in controlled descent or ascent, the device follows the displacement of the user without causing blocking; the device is free to run along the cord (1) whatever its inclination in ascent or descent.

In FIG. 1, the body (2) of the device is seen, the part (17) joined to the body (2), the cover (13) rotating around the axel (14). In dotted line the cover (13) is in "open" position and therefore enables the introduction of the cord (1) into the interior of the device. The cover (13) is blocked, after the rotation around the axel (14), by the retractable axel (15) in the hole (16) of the cover (13). This closing system of the body (2) is an example and will not be defined in the following figures.

In FIG. 2 one sees, at the bottom of the body (2) of the device, a lever (18) joined to the pushing member (9) located in the interior and the assembly being articulated by the axel (20). The lever (18) enables manual activation of the pushing member (9) by releasing it from the retractable cog (19). When the lever (18) is retained under the retractable cog (19), the device is in "follow-up fall" mode. It allows a controlled running of the cord (1) thus a displacement of the user in controlled descent and ascent without causing blocking. In contrast, when the lever (18) is released from the retractable cog (19), as shown in dotted line in FIG. 2, the device is in "blocking" mode. It thus allows only the running of the cord (1) in a direction corresponding to an upward displacement of the user and will cause a blocking of the cord (1) in the opposite direction during the descent, for example.

This lever (18) enables the user during the climbing of a cliff for example with the device in "follow-up fall prevention" mode to switch to "blocker" mode in order to be held by the cord (1) for crossing an excessively difficult passage, for example, then return to "follow-up fall prevention" mode to continue his upward or downward progression.

In FIGS. 1 and 2, the release lever (10) folded in the interior the body (2) is seen. All of the parts that constitute the device are preferably made of metal, of the injected or stamped aluminum type.

According to other implementation modes, certain essential members of the device could be made of steel. Then an overmoulding of durable plastic of these said essential members could form the body of the device.

FIG. 3 shows the operation of the device when it is in "follow-up fall prevention" mode (the lever (18) is thus retained under the retractable cog (19) shown in FIG. 2). The parts necessary to the operation of the device are seen:

on one side of the cord (1) a cord bearing surface (4)

on the other side of the cord (1), opposite the bearing surface (4), a cavity (5) containing a free weight (7) in the lower part and forming in the upper part a bearing surface (6) inclined toward the cord (1).

The pressure member (8) is articulated rotationally free around the axel (22) and applies a pressure on the free weight (7) by the effect of a tension spring (24). This said tension spring (24) compensates to a large extent the weight of the free weight (7).

Having a direction of pressure, the pressure member (8) thus enables the free weight (7) to be always in contact with the cord (1) and remain in the said lower part of the cavity (5) without touching the inclined bearing surface (6), whatever the inclination of the cord (1) and whatever the position of the device.

During the displacement in the direction of the ascent of the user, the free weight (7) rolls on the cord (1) and spins on the lower bearing surface (21) of the cavity (5). The cord (1) drives the free weight (7) and it is observed that the direction of rotation always tends to press the free weight (7) against the cord (1) and against the lower bearing surface (21). The free weight (7) thus cannot cause blocking. During a controlled descent the free weight (7) rolls on the cord (1) and spins on the lower bearing surface (21) but, its direction of rotation being inverse, the free weight (7) tends to move away from the fixed cord (1) toward the inclined bearing surface (6). It is understood that during a controlled descent the pressure member (8) is going to maintain a pressure on the free weight (7) in order to position it always in contact with the cord (1) and at the bottom of the cavity (5) against the lower bearing surface (21). The free weight (7) is thus going to roll on the cord (1), to skid on the lower bearing surface (21) and on the pressure member (8) without causing blocking. The skidding of the free weight (7) on the lower bearing surface (21) and on the pressure member (8) is understandable because, first, the coefficient of friction of the cord (1) on the free weight (7) is greater than the coefficient of friction of the contact zones of the pressure member (8) and of the lower bearing surface (21), across the size of the contact surfaces and across the nature of the materials, and, second, the direction of the pressure from the pressure member (8) on the free weight (7) being towards the cord (1) and towards the lower bearing surface (21) thus opposite from the inclined bearing surface (6).

It is further understood that during a fall of the user, the device in "follow-up fall prevention" mode is going to cause an acceleration of the running of the cord (1) in the device, thus the rotational acceleration of the free weight (7), which causes an increase of friction on the pressure member (8), which thereby drives the displacement of the free weight (7) to the top of the cavity (5) pushing back the pressure member (8). Then the free weight (7) is going to roll on the inclined bearing surface (6) until the blocking of the cord (1) between the free weight (7) and the bearing surface (4).

The pressure member (8) gives a high reliability to the device even if it is used with different diameters of cord.

In another version of the device, one can easily imagine the adjustment of the force of the pressure member (8) by adjusting the tension of the spring (24) by positioning the fixed attachment point (23) on an eccentric. Thus, the speed at which the device in "follow-up fall prevention" mode is going to block the cord (1) will be adjustable using this eccentric.

The dimension, the shape and the surface condition of the free weight (7) determine the other parameters of the device. A free weight, having a triangular shape in side view, comprising a wheel carriage between the said free weight and the inclined bearing surface is another way to implement the blocking system of the device; Thus numerous implementation modes can be imagined, but a smooth surface condition of the free weight (7) will be preferable in order to not deteriorate the cords.

FIG. 4 is a partial section of the device in "blocker" mode.

The pushing member (9) joined with the exterior lever (18) is shown in active position. The user is free to displace himself upward and the device will cause the blocking of the cord (1) in the direction of descent. The pushing member (9) being joined to the lever (18) (shown in dotted line in FIG. 2), it is thus in active position when it is free to pivot on the axis (20), in order to push the free weight (7) against the cord (1) and against the inclined bearing surface (6) using the force of a traction spring (25). This said traction spring (25) has a sufficiently great force in order that the free weight (7) pushes back the pressure member (8) and comes positively abutted against the cord (1) and against the inclined bearing surface (6). The pushing member (9) joined with the lever (18) is in inactive position as shown in FIG. 3, when the lever (18) is retained under the retractable cog (19), as shown in FIG. 2. The lever (18) must be manually activated to switch from "follow-up fall prevention" mode to "blocker" mode.

FIG. 5 is a partial section of the device in "descender" mode, that is to say, when the user is suspended from the cord (1) by blocking of the device, after a fall, or during rappelling descent.

The free weight (7) in the blocked position is seen, the carabiner attachment (12) partially shown with an arrow indicating the direction of forces on the device, and it is seen that the cord (1) is wrapped around the friction part (26) of the device.

In fact, the attachment hole (28) in the body (2) of the device being above the blocking system when the device is in use position for an ascent (FIGS. 1, 2, 3 and 4), it causes tilting of the device at the rounded end (27) of the friction part (26) during blocking of the cord (1). The cord (1) is located wrapped around the friction part (26), which increases the frictions, facilitates the control of the descent by rappelling and uses less cords.

The lever (10) folded, and in dotted line, is seen; the lever (10) in the process of releasing the free weight (7) is seen, thus causing the slippage of the cord (1) thus the descent of the user.

FIGS. 3, 4, 5 have been explained when the device is used as fall prevention, but it operates the same way when used for the belay of another person. In this case the device is fixed and the cord (1) is mobile.

FIG. 6 is a sectional view showing another implementation mode of the pressure member (8), the other parts not being shown for greater for clarity.

In this implementation mode the pressure member (8) is seen, this time articulated at the point (30), supporting on each side of the free weight (7') on the axel (29) by the force of a traction spring (31) thus enabling the free weight (7') to be always in contact with the cord (1). It is observed that the said axel (29) is rotationally free relative to the free weight (7') the latter being a rim comprising a central hole approximately 3 times larger than the diameter of the axel (29). It is also observed that the pressure member (8) comprises a shape enabling maintenance of the axel (29) in a defined position and that this said shape is extended from an inclined part (32) the latter enabling maintenance of the axel (29) towards the bottom, which thus enables the free weight (7') to not touch the inclined bearing surface (6) during the controlled running of the cord (1). This implementation mode of the pressure member (8) enables increase of the reliability of the device because of the fact that the pressure member (8) rests on the axel (29). This decreases the frictions on the pressure member (8) and the force of the spring (31) can thus be increased, which enables an excellent contact of the free weight (7') on the cord (1). Furthermore, the fact that the free weight (7') is a rim, increases the sensitivity of contact between said weight and the cord (1), which enables accentuation of the inclined part (32) of said pressure member thus increasing the reliability of the controlled running of the cord (1) and avoiding the inopportune blocking of the cord. In another implementation mode of the free weight (7') not shown, the latter can comprise an off-center mass enabling optimization of the device as explained above.

The invention claimed is:

1. A follow-up fall prevention device used with a cord designed to secure a person, the device comprising:

a body equipped with a blocking system having a position of blocking of the cord during a running of the cord at a first speed in the device, the first speed being non-zero, or a position of release allowing a running of the cord at a second speed in the device, the second speed being non-zero, the second speed being less than the first speed, the second speed corresponding to a progression of the person in a direction of a climb, or in an opposite direction during a controlled descent; and a connector configured to connect the body of the device to a safety harness, the blocking system comprising:

on a side of the cord, a cord bearing surface;

a free weight;

on an opposite side of the cord, a cavity containing in a lower part the free weight and forming in an upper part a bearing surface inclined toward the cord, the free weight being adapted, during running of the cord at the first speed, to be displaced toward the bearing surface until blocking of the cord between the free weight and the bearing surface, wherein the blocking system further includes a pressure mechanism configured, during running of the cord at the second speed, to be between the free weight and the bearing surface and to bias the free weight toward the cord and away from the bearing surface, thereby enabling the free weight to be always in contact with the cord and remain in the lower part of the cavity without touching the bearing surface, whatever the inclination of the cord and whatever the position of the device, the pressure mechanism including a spring.

2. A device according to claim 1, characterized in that the pressure member rests on an axel enabling spinning of the free weight.

3. A device according to claim 2 characterized in that the axel is rotationally free relative to the free weight.

4. A device according to claim 1, characterized in that the free weight has a smooth surface condition.

5. A device according to claim 1, characterized in that the blocking system is provided with a lever enabling release of the free weight when it is in the blocked position against the cord, even when the cord is under load.

6. A device according to claim 1, characterized in that the blocking system is provided with a pushing member activated or deactivated manually enabling in its active position the free weight to be in contact with the cord and with the inclined bearing surface.

7. A method comprising:

attaching the device according to claim 1 to a first person;

attaching a mobile cord to a second person; and subsequently, carrying out a belay of the second person by the first person, by guiding running in the device of the mobile cord.

* * * * *